US011603723B2

(12) United States Patent
Rochon et al.

(10) Patent No.: US 11,603,723 B2
(45) Date of Patent: Mar. 14, 2023

(54) CUTTINGS PROCESSING UNIT

(71) Applicant: NOV CANADA ULC, Calgary (CA)

(72) Inventors: Peter Brent Rochon, Edmonton (CA); Joel Taylor Cawkell, Edmonton (CA)

(73) Assignee: NOV CANADA ULC, Calgary (CA)

( * ) Notice: Subject to any disclaimer, the term of this patent is extended or adjusted under 35 U.S.C. 154(b) by 682 days.

(21) Appl. No.: 16/557,644

(22) Filed: Aug. 30, 2019

(65) Prior Publication Data

US 2021/0062595 A1 Mar. 4, 2021

(51) Int. Cl.

| | |
|---|---|
| ***E21B 21/06*** | (2006.01) |
| ***B02C 13/06*** | (2006.01) |
| *B02C 13/286* | (2006.01) |
| *B02C 13/28* | (2006.01) |

(52) U.S. Cl.

CPC ..... *E21B 21/066* (2013.01); *B02C 13/06* (2013.01); *B02C 13/2804* (2013.01); *B02C 2013/28654* (2013.01)

(58) Field of Classification Search

CPC ..... E21B 21/066

See application file for complete search history.

(56) References Cited

U.S. PATENT DOCUMENTS

| | | | |
|---|---|---|---|
| 295,172 | A | 3/1884 | Hill |
| 1,557,070 | A | 10/1925 | Logue |
| 2,420,803 | A | 5/1947 | Tobin |
| 2,657,017 | A | 10/1953 | Curtis |
| 2,663,375 | A | 12/1953 | Caldwell |
| 2,781,108 | A | 2/1957 | Selberg et al. |
| 3,063,509 | A | 11/1962 | Guier |
| 3,099,323 | A | 7/1963 | Kelley |
| 3,156,328 | A | 11/1964 | Bender |
| 3,228,151 | A | 1/1966 | Woolslayer et al. |

(Continued)

FOREIGN PATENT DOCUMENTS

| | | | | |
|---|---|---|---|---|
| CA | 2708191 | A1 * | 12/2011 | ..... E21B 19/22 |
| CA | 3016910 | A1 | 9/2017 | |

(Continued)

OTHER PUBLICATIONS

"Ackerman steering geometry", Wikipedia, [Online] Retrieved from the Internet : <https://en.wikipedia.org/wiki/Ackermann_steering_geometry>, (Accessed Jan. 11, 2017), 3 pgs.

(Continued)

*Primary Examiner* — Jennifer H Gay

(74) *Attorney, Agent, or Firm* — Schwegman Lundberg & Woessner, P.A.

(57) ABSTRACT

A cuttings processing unit may include a conveyor interface configured to interface with a mud cleaning complex to receive drill cuttings. The cuttings processing unit may further include a breaker mill module operably positioned to receive the cuttings via the conveyor interface, a cuttings tank module operably positioned beneath the breaker mill module, and a pump module operably positioned beneath the cuttings tank module. The breaker mill module may be configured to grind the cuttings into a finer composition. The cuttings tank module may be configured to agitate the finer composition and create a slurry. The pump module may be configured to move the slurry.

14 Claims, 8 Drawing Sheets

(56) References Cited

U.S. PATENT DOCUMENTS 3,271,915 A 9/1966 Woolslayer et al.
3,327,997 A 6/1967 Howard
3,333,377 A 8/1967 Woolslayer et al.
3,421,596 A 1/1969 Christensen
3,477,235 A 11/1969 Branham et al.
3,483,933 A 12/1969 Dyer et al.
3,502,166 A 3/1970 Christenson et al.
3,774,780 A 11/1973 Buffington
3,807,109 A 4/1974 Jenkins et al.
3,828,513 A 8/1974 Vanderklaauw
3,911,980 A 10/1975 Mccoll
3,922,825 A 12/1975 Eddy et al.
3,942,593 A 3/1976 Reeve, Jr. et al.
3,949,818 A 4/1976 Russell
3,977,542 A 8/1976 Stolzer
4,068,487 A 1/1978 Pease et al.
4,081,932 A 4/1978 Armstrong
4,128,229 A 12/1978 Elliston
4,135,340 A 1/1979 Cox et al.
4,269,395 A 5/1981 Newman et al.
4,290,495 A 9/1981 Elliston
4,324,077 A 4/1982 Woolslayer
4,336,840 A 6/1982 Bailey
4,366,650 A 1/1983 Patterson
4,375,241 A 3/1983 Gallon
4,375,892 A 3/1983 Jenkins et al.
4,387,814 A 6/1983 Beduhn et al.
4,421,447 A 12/1983 Gudgel et al.
4,474,254 A * 10/1984 Etter ..... E21B 21/06 366/136
4,480,702 A * 11/1984 Kelly, Jr. ..... E21B 41/005 264/117
4,546,783 A * 10/1985 Lott ..... E21B 41/005 134/109
4,587,778 A 5/1986 Woolslayer et al.
4,823,870 A 4/1989 Sorokan
4,831,795 A 5/1989 Sorokan
4,837,992 A 6/1989 Hashimoto
4,885,893 A 12/1989 Wasterval, Jr. et al.
5,028,010 A * 7/1991 Sansing ..... B09B 3/00 241/101.8
5,216,867 A 6/1993 Wasterval, Jr. et al.
5,303,786 A * 4/1994 Prestridge ..... E21B 21/066 175/207
5,361,998 A * 11/1994 Sirevag ..... E21B 21/066 241/101.8
5,407,302 A 4/1995 Springett et al.
5,492,436 A 2/1996 Suksumake
5,842,529 A * 12/1998 Dietzen ..... E21B 41/005 175/207
5,954,453 A 9/1999 Thomas
5,996,484 A * 12/1999 Reddoch ..... B30B 9/12 100/106
5,997,217 A 12/1999 Verret
6,045,297 A 4/2000 Voorhees et al.
6,054,829 A 4/2000 Young et al.
6,106,733 A * 8/2000 Wood ..... E21B 21/066 210/806
6,141,870 A 11/2000 Mcdermott et al.
6,148,940 A 11/2000 Hokanson et al.
6,171,027 B1 1/2001 Blankestijin
6,234,527 B1 5/2001 Poulin et al.
6,286,615 B1 9/2001 Bitelli
6,412,576 B1 7/2002 Meiners
6,474,926 B2 11/2002 Weiss
6,634,436 B1 10/2003 Desai
6,729,804 B1 5/2004 Roodenburg et al.
6,936,092 B2 * 8/2005 Seyffert ..... E21B 21/066 95/271
6,988,567 B2 * 1/2006 Burnett ..... E21B 21/065 175/66
6,994,171 B2 2/2006 Orr et al.
6,997,647 B2 2/2006 Bennett, Jr. et al.
7,182,163 B1 2/2007 Gipson
7,306,057 B2 * 12/2007 Strong ..... B01D 21/2444 134/25.1
7,308,953 B2 12/2007 Barnes
7,325,629 B2 * 2/2008 Blaschke ..... E21B 41/0057 175/205
7,360,589 B2 4/2008 Moncus et al.
7,410,326 B2 8/2008 Morrison et al.
7,584,809 B1 9/2009 Flud
7,624,831 B2 12/2009 Orr et al.
7,765,749 B2 8/2010 Palidis
7,931,076 B2 4/2011 Ditta et al.
7,950,478 B2 5/2011 Terry
8,047,303 B2 11/2011 Donnally et al.
8,287,212 B2 10/2012 Roper
8,468,753 B2 6/2013 Donnally et al.
8,516,751 B2 8/2013 Konduc et al.
8,549,815 B2 10/2013 Donnally et al.
8,555,564 B2 10/2013 Wasterval
8,556,003 B2 10/2013 Souchek
8,875,911 B2 11/2014 Donnally et al.
8,950,510 B2 * 2/2015 Bender ..... E21B 21/06 175/66
9,091,125 B2 7/2015 Konduc et al.
9,091,126 B2 7/2015 Thiessen et al.
9,109,399 B2 8/2015 Murr et al.
9,212,778 B2 12/2015 Winter
9,334,699 B2 * 5/2016 Bender ..... E21B 21/01
9,463,833 B2 10/2016 Smith et al.
9,488,014 B2 11/2016 Sparkman et al.
9,574,413 B1 * 2/2017 Farquhar ..... E21B 41/005
9,797,196 B2 10/2017 Taggart et al.
RE46,723 E 2/2018 Smith et al.
9,926,719 B2 3/2018 Reddy et al.
10,293,854 B2 5/2019 Nguyen et al.
10,471,986 B2 11/2019 Nguyen et al.
10,822,924 B2 * 11/2020 Konduc ..... E21B 41/00
11,021,186 B2 6/2021 Nguyen et al.
11,091,966 B2 * 8/2021 Mallonee ..... E21B 21/06
2001/0039887 A1 * 11/2001 Reddoch ..... B30B 9/26 100/117
2002/0185319 A1 12/2002 Smith
2003/0102166 A1 6/2003 Jortveit
2003/0147726 A1 8/2003 Tolmon et al.
2003/0172599 A1 9/2003 Frink
2004/0151549 A1 8/2004 Roodenburg et al.
2004/0182605 A1 * 9/2004 Seyffert ..... E21B 21/066 175/5
2004/0211572 A1 10/2004 Orr et al.
2004/0211598 A1 10/2004 Palidis
2004/0240973 A1 12/2004 Andrews et al.
2005/0029015 A1 * 2/2005 Burnett ..... E21B 21/066 175/5
2005/0279715 A1 * 12/2005 Strong ..... E21B 21/066 210/806
2006/0180564 A1 8/2006 Keppel
2007/0119628 A1 * 5/2007 Reddoch ..... E21B 21/066 175/216
2007/0272762 A1 11/2007 Click et al.
2008/0257607 A1 10/2008 Winter
2009/0000218 A1 1/2009 Lee et al.
2009/0188677 A1 7/2009 Ditta et al.
2009/0277632 A1 * 11/2009 Frazier ..... E21B 21/066 166/267
2009/0283324 A1 11/2009 Konduc et al.
2009/0321135 A1 12/2009 Vora
2010/0147779 A1 * 6/2010 Miller ..... B01D 21/2461 210/768
2010/0150660 A1 6/2010 Nadarajah et al.
2010/0260555 A1 10/2010 Foo et al.
2010/0303586 A1 12/2010 Hankins et al.
2011/0072737 A1 3/2011 Wasterval
2011/0079568 A1 4/2011 Mau et al.
2011/0114386 A1 5/2011 Souchek
2011/0280104 A1 11/2011 Mcclung, III
2012/0047820 A1 3/2012 Donnally et al.
2012/0138327 A1 6/2012 Sorokan et al.
2012/0201632 A1 8/2012 Yater et al.
2012/0304553 A1 12/2012 Konduc et al.

(56) References Cited

U.S. PATENT DOCUMENTS

| | | | | |
|---|---|---|---|---|
| 2013/0168516 | A1 | 7/2013 | Winter | |
| 2013/0180186 | A1 | 7/2013 | Konduc et al. | |
| 2013/0269268 | A1 | 10/2013 | Thiessen et al. | |
| 2013/0305632 | A1 | 11/2013 | Rivera, Sr. et al. | |
| 2013/0340572 | A1 | 12/2013 | Flusche | |
| 2013/0340998 | A1 | 12/2013 | Flusche | |
| 2013/0341036 | A1 | 12/2013 | Flusche | |
| 2014/0041855 | A1 | 2/2014 | Rodgers | |
| 2014/0090333 | A1 | 4/2014 | Vogt | |
| 2014/0158342 | A1 | 6/2014 | Smith et al. | |
| 2014/0259985 | A1 | 9/2014 | Petrello et al. | |
| 2014/0262518 | A1 | 9/2014 | Reddy et al. | |
| 2014/0262519 | A1 | 9/2014 | Petrello et al. | |
| 2014/0262520 | A1 | 9/2014 | Petrello et al. | |
| 2014/0263685 | A1 | 9/2014 | Yustus et al. | |
| 2014/0270974 | A1 | 9/2014 | Seng et al. | |
| 2014/0270975 | A1 | 9/2014 | Seng et al. | |
| 2014/0331570 | A1 | 11/2014 | Fullerton et al. | |
| 2015/0014952 | A1 | 1/2015 | Morikawa | |
| 2015/0090450 | A1 | 4/2015 | Thiessen | |
| 2015/0122558 | A1 | 5/2015 | Van Raden | |
| 2015/0129312 | A1* | 5/2015 | Bender | E21B 21/06 175/66 |
| 2015/0152690 | A1 | 6/2015 | Sorokan et al. | |
| 2015/0184466 | A1 | 7/2015 | Rivera, Sr. et al. | |
| 2015/0218891 | A1 | 8/2015 | Padira et al. | |
| 2015/0300038 | A1 | 10/2015 | Thiessen et al. | |
| 2016/0052441 | A1 | 2/2016 | Korach | |
| 2016/0090788 | A1 | 3/2016 | Niemczyk | |
| 2016/0369523 | A1 | 12/2016 | Konduc et al. | |
| 2017/0014877 | A1* | 1/2017 | Hartley | E21B 21/066 |
| 2017/0081924 | A1 | 3/2017 | Smith et al. | |
| 2017/0241126 | A1 | 8/2017 | Konduc et al. | |
| 2017/0254181 | A1 | 9/2017 | Konduc et al. | |
| 2017/0320660 | A1* | 11/2017 | Sanders | B65G 65/425 |
| 2018/0093705 | A1 | 4/2018 | Nguyen et al. | |
| 2018/0093706 | A1 | 4/2018 | Nguyen et al. | |
| 2019/0233006 | A1 | 8/2019 | Nguyen et al. | |
| 2019/0301253 | A1* | 10/2019 | Mallonee | E21B 21/06 |
| 2020/0240217 | A1* | 7/2020 | Jonah | E21B 41/00 |
| 2021/0025263 | A1 | 1/2021 | Konduc et al. | |
| 2021/0062595 | A1* | 3/2021 | Rochon | E21B 21/066 |
| 2021/0172260 | A1 | 6/2021 | Konduc et al. | |

FOREIGN PATENT DOCUMENTS

| | | | | | |
|---|---|---|---|---|---|
| CN | 101476312 | A | | 7/2009 | |
| CN | 102536267 | A | | 7/2012 | |
| CN | 105331343 | A | * | 2/2016 | C09K 8/508 |
| CN | 110344779 | A | * | 10/2019 | E21B 21/06 |
| CN | 111636833 | A | * | 9/2020 | E21B 21/01 |
| DE | 19507172 | A1 | * | 8/1996 | B03B 9/00 |
| GB | 2112049 | A | * | 7/1983 | B09B 1/00 |
| NO | 335252 | B1 | * | 10/2014 | B65G 53/10 |
| RU | 81516 | U1 | | 3/2009 | |
| RU | 96904 | U1 | | 8/2010 | |
| RU | 137053 | U1 | | 1/2014 | |
| SU | 1461858 | A1 | | 2/1989 | |
| SU | 1686052 | A1 | | 10/1991 | |
| SU | 1770509 | A1 | | 10/1992 | |
| WO | WO-9209379 | A1 | * | 6/1992 | B09B 1/008 |
| WO | WO-9320328 | A1 | * | 10/1993 | B09B 1/00 |
| WO | WO-2004094762 | A2 | | 11/2004 | |
| WO | WO-2008114064 | A1 | | 9/2008 | |
| WO | WO-2009002189 | A1 | | 12/2008 | |
| WO | WO-2010132174 | A1 | | 11/2010 | |
| WO | WO-2017155950 | A1 | | 9/2017 | |
| WO | WO-2018025059 | A1 | * | 2/2018 | E21B 21/06 |
| WO | WO-2018064746 | A1 | | 4/2018 | |
| WO | WO-2020028969 | A1 | | 2/2020 | |

OTHER PUBLICATIONS

"U.S. Appl. No. 15/285,946, Non Final Office Action dated Dec. 11, 2018", 8 pgs.
"U.S. Appl. No. 15/285,946, Notice of Allowance dated Jul. 9, 2019", 5 pgs.
"U.S. Appl. No. 15/285,946, Response filed Sep. 5, 2018 to Restriction Requirement dated Jul. 5, 2018", 6 pgs.
"U.S. Appl. No. 15/285,946, Response filed Mar. 11, 2019 to Non-Final Office Action dated Dec. 11, 2018", 8 pgs.
"U.S. Appl. No. 15/285,946, Restriction Requirement dated Jul. 5, 2018", 6 pgs.
"U.S. Appl. No. 15/349,661, Notice of Allowance dated Jan. 3, 2019", 8 pgs.
"U.S. Appl. No. 15/349,661, Response filed Oct. 26, 2018 to Restriction Requirement dated Aug. 28, 2018", 6 pgs.
"U.S. Appl. No. 15/349,661, Restriction Requirement dated Aug. 28, 2018", 5 pgs.
"U.S. Appl. No. 15/451,968, Non Final Office Action dated Sep. 10, 2018", 8 pgs.
"U.S. Appl. No. 15/451,968, Preliminary Amendment filed Sep. 5, 2018", 5 pgs.
"U.S. Appl. No. 15/451,968, Response filed May 6, 2020 to Restriction Requirement dated Mar. 6, 2020", 5 pgs.
"U.S. Appl. No. 15/451,968, Response filed Nov. 18, 2019 to Restriction Requirement dated Sep. 18, 2019", 6 pgs.
"U.S. Appl. No. 15/451,968, Response filed Dec. 16, 2018 to Non Final Office Action dated Sep. 10, 2018", 10 pgs.
"U.S. Appl. No. 15/451,968, Response filed Jun. 5, 2019 to Restriction Requirement dated Apr. 5, 2019", 7 pgs.
"U.S. Appl. No. 15/451,988, Restriction Requirement dated Mar. 6, 2020", 6 pgs.
"U.S. Appl. No. 15/451,968, Restriction Requirement dated Apr. 5, 2019", 6 pgs.
"U.S. Appl. No. 15/451,968, Restriction Requirement dated Sep. 18, 2019", 6 pgs.
"U.S. Appl. No. 16/382,961, Non Final Office Action dated May 14, 2020", 7 pgs.
"Axles & Suspension Wheeled Moving System", Columbia Industries, [Online] Retrieved from the Internet: <http://www.joomag.com/magazine/columbiaindustries/0320299001391629028>, (Accessed Jan. 11, 2017), 4 pgs.
"Axles and Suspension", Columbia Industries, [Online] Retrieved from the Internet: <http://www.columbiacorp.com/axlesandsuspension.php>, (Mar. 17, 2016), 2 pgs.
"*Blue Calypso, LLC* v. *Groupon, Inc.*", CAFC, (Mar. 1, 2016), 46 pgs.
"Canadian Application Serial No. 3,016,910, Voluntary Amendment filed Jul. 8, 2019", 13 pgs.
"Entro Heavy Haul", Entro Industries, [Online] Retrieved from the Internet : <https://entro-eng.com/products/heavy-haul/heavy-haul-overview/>, (Accessed Jan. 11, 2017), 2 pgs.
"Entro Industries Homepage", [Online] Retrieved from the Internet : <https://entroeng.com/>, (Accessed Jan. 18, 2017), 2 pgs.
"European Application Serial No. 12791970.2, Extended European Search Report dated Sep. 2, 2015", 8 pgs.
"European Application Serial No. 12791970.2, Response filed Mar. 9, 2016 to Extended European Search Report dated Sep. 2, 2015", 32 pgs.
"In re Wolfensperger", 302 F.2d 950 (CCPA 1962), (May 18, 1962), 8 pgs.
"International Application Serial No. PCT/CA2012/000510, Response filed Mar. 14, 2013 to Written Opinion dated Aug. 24, 2012", 4 pgs.
"International Application Serial No. PCT/CA2012/000510, Written Opinion dated Aug. 24, 2012", 3 pgs.
"International Application Serial No. PCT/CA2015/000432, International Search Report dated Sep. 24, 2015", 3 pgs.
"International Application Serial No. PCT/CA2015/000432, Written Opinion dated Sep. 24, 2015", 5 pgs.
"International Application Serial No. PCT/CA2016/000229, International Search Report dated Oct. 26, 2016", 3 pgs.
"International Application Serial No. PCT/CA2016/000229, Written Opinion dated Oct. 26, 2016", 5 pgs.

(56) References Cited

OTHER PUBLICATIONS

"International Application Serial No. PCT/CA2017/000215, International Preliminary Report on Patentability dated Jan. 21, 2019", 5 pgs.
"International Application Serial No. PCT/CA2017/000215, International Search Report dated Jan. 9, 2018", 4 pgs.
"International Application Serial No. PCT/CA2017/000215, Written Opinion dated Jan. 9, 2018", 6 pgs.
"International Application Serial No. PCT/CA2019/000114, Article 34 Amendments filed Jun. 1, 2020", 8 pgs.
"International Application Serial No. PCT/CA2019/000114, International Search Report dated Nov. 20, 2019", 3 pgs.
"International Application Serial No. PCT/CA2019/000114, Written Opinion dated Nov. 20, 2019", 5 pgs.
"International Application Serial No. PCT/US2014/037431, International Search Report dated Oct. 7, 2014", 2 pgs.
"International Application Serial No. PCT/US2014/037431, Written Opinion dated Oct. 7, 2014", 6 pgs.
"International Application Serial No. PCT/US2016/019507, International Search Report dated Dec. 21, 2016", 6 pgs.
"International Application Serial No. PCT/US2016/019507, Written Opinion dated Dec. 21, 2016", 9 pgs.
"International Application Serial No. PCT/US2017/021095, International Preliminary Report on Patentability dated Sep. 20, 2018", 11 pgs.
"International Application Serial No. PCT/US2017/021095, International Search Report dated Jun. 12, 2017", 5 pgs.
"International Application Serial No. PCT/US2017/021095, Written Opinion dated Jun. 12, 2017", 9 pgs.
"Nabors Oil Rig Move", YouTube, [Online] Retrieved from the Internet : <https://www.youtube.com/watch?v=T4ELOeh6R6M>, (Oct. 22, 2008), 2 pgs.
"National Oilwell Varco Elevator/Substructure/Setback Cross-Section drawing", (Jul. 24, 1979), 1 pg.
"National Oilwell Varco Mast & Substructure Erection Sequence drawing", (Sep. 15, 1979), 1 pg.
"Photograph of Uralmesh rig", (Jul. 2014), 1 pg.
"Photographs of typical Uralmesh train rig", (Sep. 2012), 2 pgs.
"Pin-on Walkers for Ideal® Rigs", Entro Industries, [Online] Retrieved from the Internet : <https://entro-eng.com/products/walking-systems/ideal-pin-on-walkers/>, (Accessed Jan. 11, 2017), 2 pgs.
"Steering", Wikipedia, [Online] Retrieved from the Internet : <https://en.wikipedia.org/wiki/Steering>, (Accessed Jan. 11, 2017), 12 pgs.
"U.S. Appl. No. 16/948,994, Response filed Feb. 24, 2022 to Restriction Requirement dated Dec. 24, 2021", 6 pgs.
"U.S. Appl. No. 17/250,576, Non-Final Office Action dated Mar. 2, 2022", 15 pgs.
"U.S. Appl. No. 16/948,994, Non-Final Office Action dated Mar. 24, 2022", 10 pgs.
U.S. Appl. No. 17/250,576, filed Feb. 4, 2021, Drill Floor Support Structures.
U.S. Appl. No. 16/948,994, filed Oct. 8, 2020, Multi-Well BOP Cellar Trailer.
"U.S. Appl. No. 15/451,968, Notice of Allowance dated Aug. 11, 2020", 7 pgs.
"U.S. Appl. No. 15/451,968, Supplemental Notice of Allowability dated Sep. 30, 2020", 4 pgs.
"U.S. Appl. No. 16/382,961, Final Office Action dated Nov. 12, 2020", 8 pgs.
"U.S. Appl. No. 16/382,961, Notice of Allowance dated Jan. 28, 2021", 5 pgs.
"U.S. Appl. No. 16/382,961, Response filed Jan. 13, 2021 to Final Office Action dated Nov. 12, 2020", 6 pgs.
"U.S. Appl. No. 16/382,961, Response filed Aug. 10, 2020 to Non Final Office Action dated May 14, 2020", 7 pgs.
"U.S. Appl. No. 16/948,994, Restriction Requirement dated Dec. 24, 2021", 6 pgs.
U.S. Appl. No. 15/285,946 U.S. Pat. No. 10,471,986, filed Oct. 5, 2016, Movable Rig and Steering System.
U.S. Appl. No. 15/349,661 U.S. Pat. No. 10,293,854, filed Nov. 11, 2016, Movable Rig and Steering System.
U.S. Appl. No. 16/382,961, filed Apr. 12, 2019, Movable Rig and Steering System.
U.S. Appl. No. 15/451,968, filed Mar. 7, 2017, Multi-Well BOP Cellar Trailer.

* cited by examiner

CUTTINGS PROCESSING UNIT

TECHNOLOGICAL FIELD

The present application relates to oil and gas drilling. More particularly, the present application relates to cuttings treatment equipment that processes cuttings produced by a drilling rig.

BACKGROUND

The background description provided herein is intended to generally present the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During operation of a drilling rig, the drill bit cuts the formation into small pieces, called cuttings. The unregulated dumping of cuttings produced by drilling rigs is generally regarded as socially and environmentally unacceptable. One acceptable method to manage the disposal of drill cuttings is to transport the cuttings off-site for treatment and thereafter bury the cuttings as landfill or inject the cuttings into an old reservoir. Some conventional systems and methods for dealing with cuttings include using a traditional rock washer positioned perpendicular to the mud cleaning complex such that a narrow side of the traditional rock washer interfaces with the mud complex to collect the cuttings and mud and eventually transport them off-site. Conventional systems and methods can be oversized, cumbersome, inefficient, obtrusive, obstructing, etc.

SUMMARY

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more embodiments, a cuttings processing unit may include a utility interface configured to interface with a mud cleaning complex to receive drill cuttings. The cuttings processing unit may further include a breaker mill module operably positioned to receive the cuttings via the conveyor interface and the breaker mill module may be configured to grind the cuttings into a finer composition. The cuttings processing unit may further include a cuttings tank module operably positioned beneath the breaker mill module, and the cuttings tank module may be configured to agitate the finer composition and create a slurry. The cuttings processing unit may further include a pump module operably positioned beneath the cuttings tank module, and the pump module may be configured to pump the slurry.

In one or more other embodiments, a cuttings processing unit may include a breaker mill configured to receive cuttings from a mud cleaning complex and grind the cuttings into a finer composition. The cuttings processing unit may include a cuttings tank positioned beneath the breaker mill. The cuttings tank may be configured to receive the finer composition and may include an auger configured to agitate contents of the cuttings tank. The cuttings tank may be configured to transform the finer composition into a slurry. The cuttings processing unit may further include at least one pump positioned beneath the cuttings tank. The cuttings processing unit may further include piping in fluid connection with the cuttings tank and the at least one pump, such that the at least one pump may be configured to pump the slurry through the piping.

In one or more embodiments, a method of processing cuttings of a drilling rig may include assembling a cuttings process unit. Forming the cuttings processing unit may include positioning a cuttings tank module on top of a pump module, positioning a breaker mill module on top of the cuttings tank module, and configuring a utilities interface to interface with a mud cleaning complex to receive cuttings from the mud cleaning complex. The method may further include receiving the cuttings in the cuttings processing unit via the utilities interface. The method may further include grinding the cuttings with a mill of the breaker mill module to produce a finer composition. The method may further include using the finer composition to produce a slurry in a cuttings tank of the cuttings tank module. The method may further include pumping the slurry through piping using at least one pump of the pumping module.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present application, in one or more embodiments, includes a cuttings processing unit arranged in a condensed and efficient configuration that minimizes the total area required for a drilling rig and allows for easier access to the rig and other equipment while allowing for onsite refinement and processing of the cuttings. The cuttings processing unit may be a modular system that may be separated into individual modules as needed, assembled to form a single integrated unit, and disassembled for maintenance, replacement of individual modules, removal, or the like. In some embodiments, the cuttings processing unit may include a utility interface module, a breaker mill module, a cuttings tank module, a pump module, and a control center module. One or more of these modules may be stacked vertically so as to reduce the physical footprint of the cuttings processing unit on the rig pad and to allow for easy access to the drilling rig and other equipment as well as to allow room for maneuvering in the courtyard of the rig pad. The cuttings processing unit may include a transporter that allows the unit to be mobile adding flexibility and easing installation. In some embodiments the cuttings processing unit may be modular, be fully mobile, and possess all controls on board, thus avoiding requiring modifications to the equipment receiving installation (such as the mud cleaning complex).

Figure 1:
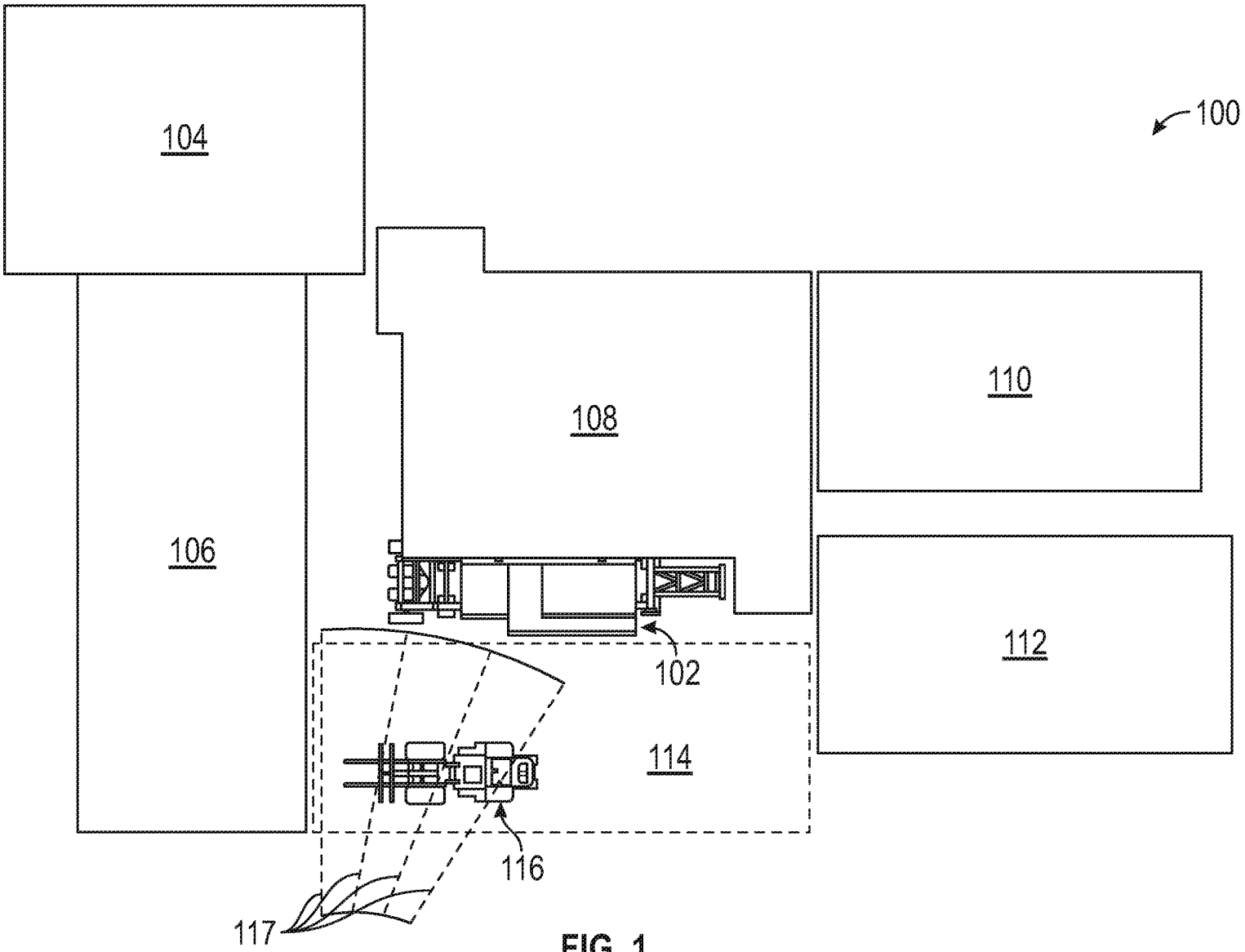
FIG. 1 is a top view of a rig pad including a cuttings processing unit, according to one or more embodiments.

FIG. 1 is a top view of a rig pad 100 including a cuttings processing unit 102, according to one or more embodiments. Rig pads 100 are generally only allocated the amount of area necessary for operation to ensure a footprint that minimizes the impact on the surrounding environment. As such, it is important to maximize the potential of the total area allotted for the rig pad 100 to ensure the most efficient usage possible. In the illustrated example, the rig pad 100 includes a drilling rig 104, a drilling rig substructure 106, a mud cleaning complex 108, a mud pump complex 110, and an engine complex 112. However, in other examples, the rig pad 100 may include more equipment, less equipment, different equipment, or a combination of these. A courtyard 114 (illustrated in dotted lines) sits in front of the mud cleaning complex 108 and to the side of the drilling rig substructure 106. Some conventional systems and methods use a traditional rock washer instead of the cuttings processing unit 102 illustrated. Traditional rock washers are very long and are positioned substantially perpendicular relative to the mud cleaning complex 108 such that a narrow side faces the mud cleaning complex 108 and the length of the traditional rock washer extends into the courtyard 114, limiting the space and usefulness of the courtyard 114. The interface and positioning of equipment of conventional solutions make it impossible for a traditional rock washer to be installed parallel to the mud cleaning complex 108. A traditional rock washer would also not be able to be moved in and out if it is positioned parallel relative to the mud cleaning complex 108.

In contrast, the cuttings processing unit 102 extends vertically and is arranged generally parallel to the mud cleaning complex 108 so as to minimize the footprint of the cuttings processing unit 102 and maximize the courtyard 114. In at least one example, a long side of the cuttings processing unit 102 runs generally parallel to the mud cleaning complex 108. In the illustrated embodiment, a machine 116 is shown maneuvering in the courtyard 114 to load or feed drill pipe 117 at the drilling rig substructure 106. The drill pipe 117 is illustrated in dotted lines to indicate different positions of the drill pipe 117 as it is moved and loaded by the machine 116. This illustrates one example of how the cuttings processing unit 102 allows for easier access to the drilling rig substructure 106 as well as allows the courtyard 114 to be better utilized.

Figure 2:
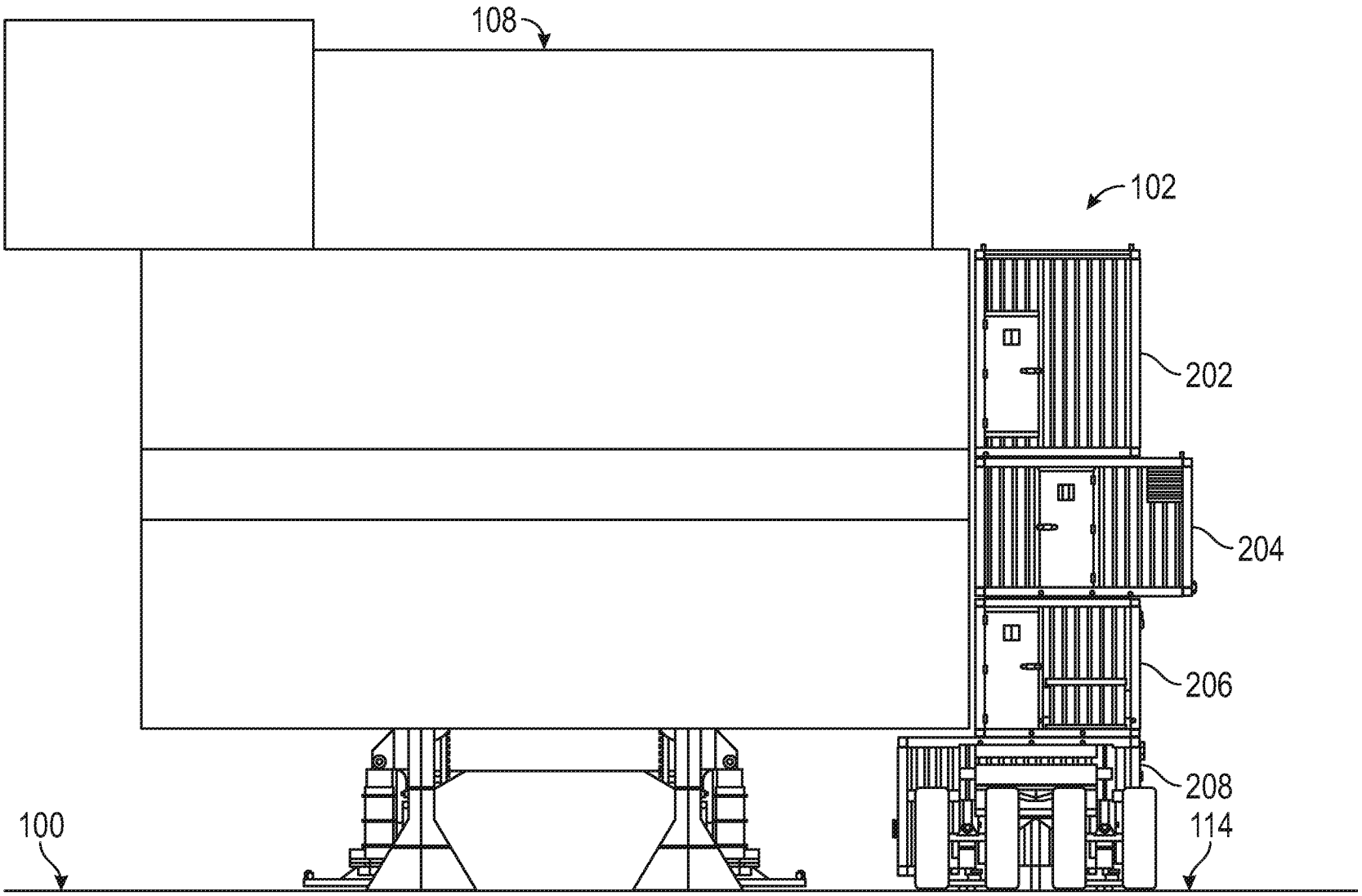
FIG. 2 is a side view of a cuttings processing unit and a mud cleaning complex, according to one or more embodiments.

FIG. 2 is a side view of a cuttings processing unit 102 and a mud cleaning complex 108, according to one or more embodiments. In the illustrated embodiment, the cuttings processing unit 102 includes a plurality of modules 202, 204, 206, 208 assembled to form the cuttings processing unit 102. As seen in FIGS. 1 and 2, a long side of the cuttings processing unit 102 faces the mud cleaning complex 108 and a short side of the cuttings processing unit 102 extends toward the courtyard 114 to minimize the impact on the courtyard 114. In the illustrated embodiment, a portion of the cuttings processing unit 102 extends beneath the mud cleaning complex 108 to allow the cuttings processing unit 102 to be bigger without impacting the courtyard 114. In other embodiments, more or less of the cuttings processing unit 102 may extend beneath the mud cleaning complex 108.

Figure 3:
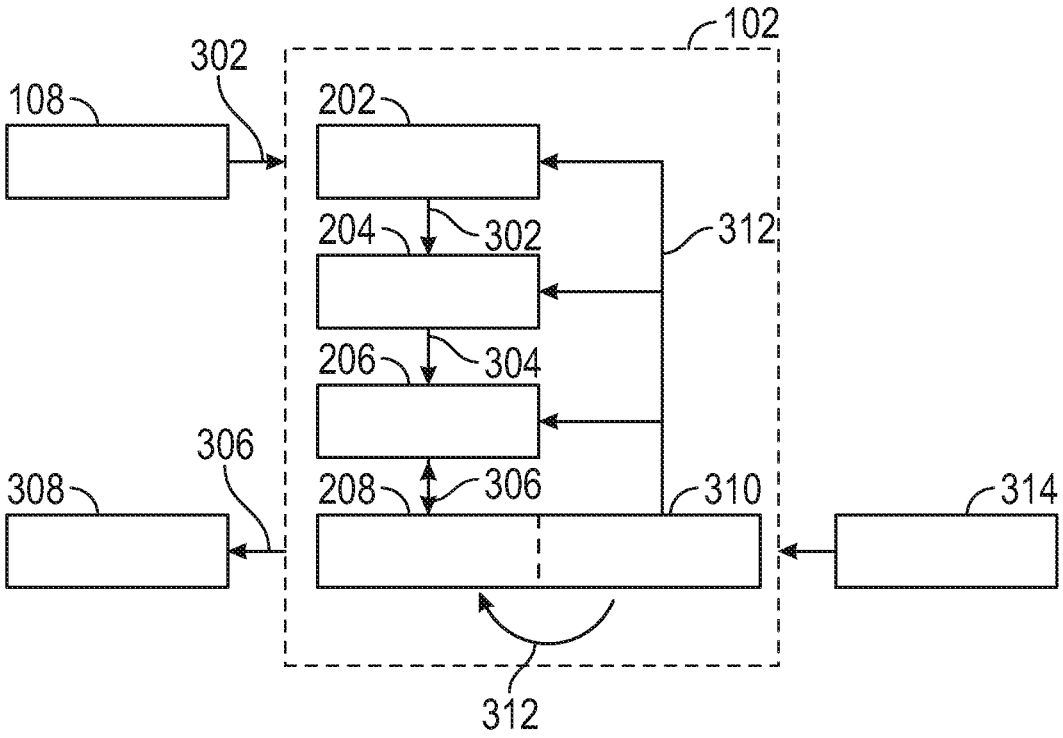
FIG. 3 is a schematic representation of a cuttings processing unit, according to one or more embodiments.

FIG. 3 is a schematic representation of a modulated cuttings processing unit 102, according to one or more embodiments. In the illustrated embodiment, the cuttings processing unit 102 includes a utility interface module 202, a breaker mill module 204, a cuttings tank module 206, and a pump module 208. The utility interface module 202 interfaces with one or more utilities, for example, the mud cleaning complex 108. The utility interface module 202 interacts with the mud cleaning complex 108 to allow cuttings (drill cuttings) 302 to pass from the mud cleaning complex 108 to the breaker mill module 204. The breaker mill module 204 grinds the cuttings 302 to produce a finer composition 304, which is passed on to the cutting tank module 206. Within the cutting tank module 206, the finer composition 304 turns into a slurry 306 which can be passed to the pump module 208. The pump module 208 can then pump the slurry 306 to an output 308, such that the slurry 306 is removed from the cuttings processing unit 102 for disposal or other purposes or in some examples, the pump module 208 can then pump the slurry 306 back into the tank 206.

The cuttings processing unit 102 may include a control module 310 to control one or more functions of the cuttings processing unit 102. The control module 310 may be in electrical communication 312 with one or more modules 202, 204, 206, 208 of the cuttings processing unit 102. For example, the control module 310 may be electrically coupled to the breaker module 204 to control the grinding of the cuttings 302, the cuttings tank module 206 to control agitation and creation of the slurry 306, and the pump module 208 to control pumping of the slurry 306. The control module 310 may couple to a power supply 314 to power the cuttings processing unit 102. In some examples, the control module 310 may electrically couple to the mud cleaning complex 108, such that the mud cleaning complex 108 is the power supply 314. In the illustrated embodiment, the control module 310 and the pump module 208 are linked to form a single unit. In some examples, the control module 310 may be a separate unit, while in others the control module 310 may be combined with any of the other modules 202, 204, 206, 208. The control module 310 may include a computer or other equipment to facilitate control of the cuttings processing unit 102. The control module 310 can allow the cuttings processing unit 102 to have all controls on board which can facilitate easier installation and control. In some embodiments, one or more of the modules 202, 204, 206, 208, 310 may be combined into a single module.

Figure 4:
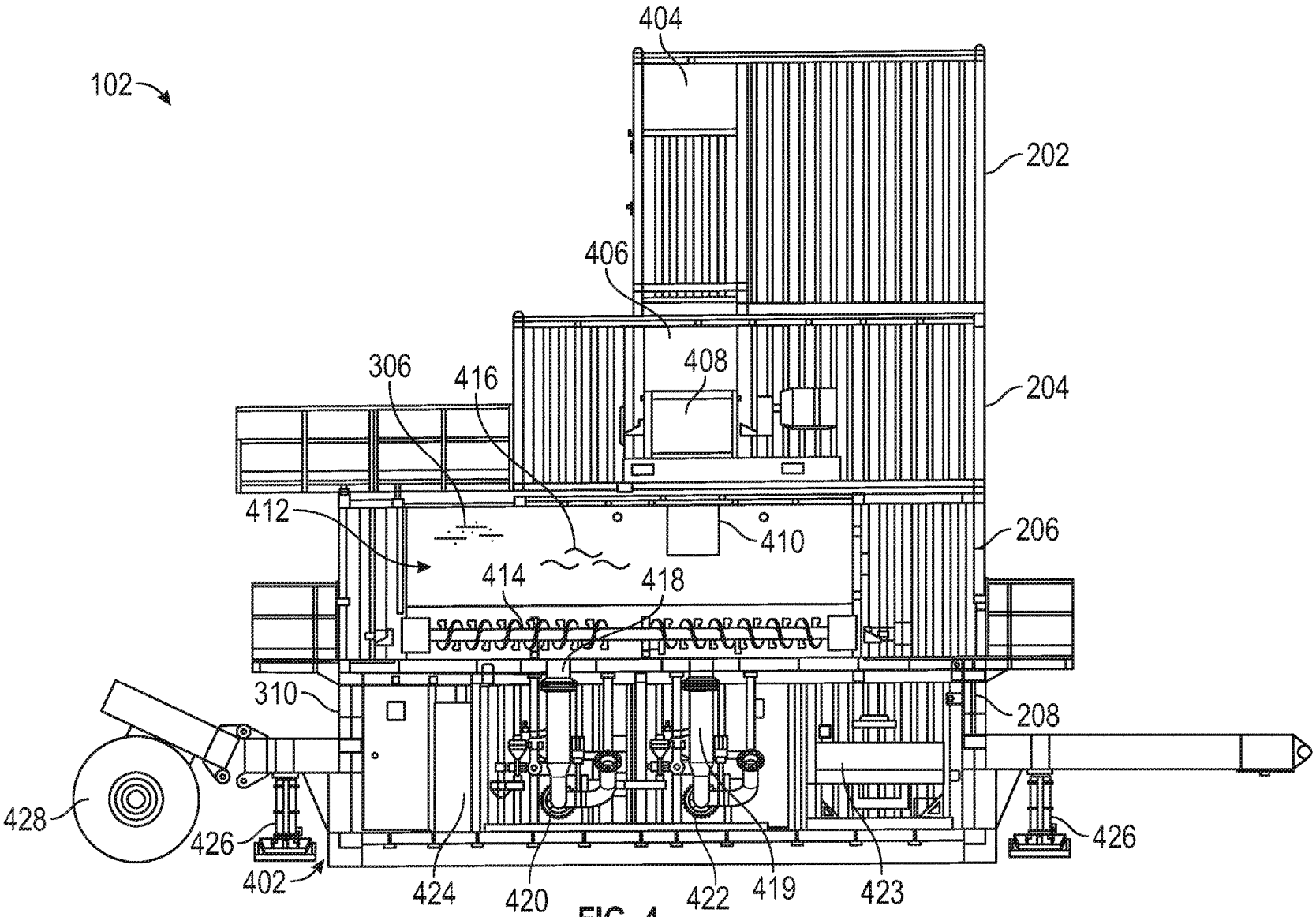
FIG. 4 is a front cross-section view of a cuttings processing unit, according to one or more embodiments.

FIG. 4 is a front cross-section view of a cuttings processing unit 102, according to one or more embodiments. The illustrated cuttings processing unit 102 includes a utilities interface module 202, a breaker mill module 204, a cuttings tank module 206, a pump module 208, a control module 310, and a transporter 402. The cuttings processing unit 102 is assembled such that the transporter 402 is positioned beneath the pump module 208 (and the control module 310), which is positioned beneath the cuttings tank module 206, which is positioned beneath the breaker mill module 204, which is positioned beneath the utilities interface module 202.

The utilities interface module 202 includes a utilities interface 404 which may interact with or otherwise interface with a portion of the utilities. For example, in the illustrated embodiment, the utilities interface 404 is a window configured to receive water, steam, air, a combination of these, or the like. In some examples, a conveyor interface 406 is defined by one or both of the utilities interface module 202 and the breaker mill module 204. The conveyor interface 406 is configured to receive a conveyor (such as a screw conveyor) of the mud cleaning complex 108, such that the conveyor will deposit the cuttings 302 within the breaker mill module 204. In at least one example, gravity will cause the cuttings 302 to proceed from the conveyor to the breaker mill module 204. In at least one example, the utilities interface 404 may be part of a different module, for example the breaker mill module 204, and such an embodiment would not include a utilities interface module 202. The utilities interface 404 interfaces with the utilities (for example, the mud cleaning complex 108) such that a long side of the cuttings processing unit 102 extends substantially parallel to the mud cleaning complex 108 so as to maximize the courtyard 114. In different embodiments, the conveyor interface 406 may be positioned in different portions of the cuttings processing unit 102, for example, the utilities interface module 202, the breaker mill module 204, or both.

The breaker mill module 204 includes a mill 408 configured to break or grind the cuttings 302 into a finer composition 304. The finer composition 304 may generally include more uniformly smaller pieces than the cuttings 302. In some embodiments, the mill 408 is a ball mill. In at least one example, gravity will cause the finer composition 304 to proceed from the breaker mill module 204 to the cuttings tank module 206. In at least one embodiment, the finer composition 304 proceeds through an opening 410 defined by the breaker mill module and the cuttings tank module 206.

The cuttings tank module 206 may include a tank 412 housing an auger 414. The tank 412 contains fluids 416, which are agitated by the auger 414. The auger 414 may further refine the finer composition 304 through agitation or grinding. In some embodiments, the auger 414 may be a solids auger. In some embodiments, the auger 414 may be positioned at the bottom of the tank 412 to avoid accumulation of the finer composition 304 at the bottom of the tank 412. The auger 414 may generally keep solids in fluid suspension. The auger 414, through agitation of the fluids 416, may cause the fluids and the finer composition 304 to form a slurry 306.

The slurry 306 may be pulled through suction piping 418, 419 to one or more pumps 420, 422 in the pump module 208. The one or more pumps 420, 422 may recirculate the slurry 306 or expel the slurry 306 from the cuttings processing unit 102. In some examples, the one or more pumps 420, 422 may be centrifugal pumps. In at least one example, the one or more pumps 420, 422 are industrial slurry pumps. The control module 310 may include controls 424 to facilitate controlling one or more functions of the cuttings processing unit 102. For example, the controls 424 may include a computer, a user interface, a motor control center (MCC), one or more physical actuators, a combination of these, or the like. In at least one example, the pump module includes a hydraulic pumping unit (HPU) 423 that provides power to hydraulic systems, for example one or more features of the transporter 402. In at least one example, the HPU 423 may provide power to skid feet, cylinders for walking the cuttings processing unit 102, a hydraulic motor to turn the auger, or other components that may be powered by hydraulics.

The transporter 402 may include a lift and roll system 426. The lift and roll system 426 may include for example, feet with hydraulics and rollers such that the lift and roll system 426 may allow the cuttings processing unit 102 to lift, rotate, and translate in any direction. In some embodiments, the transporter 402 is a wheeled transporter including wheels 428. The transporter 402 allows for easier installation, since the cuttings processing unit 102 may be moved to accommodate existing equipment, such as the mud cleaning complex 108. The transporter 402 allows for easier transportation since it does not require that it be loaded on a trailer or otherwise require further vehicles to accommodate movement.

Figure 5:
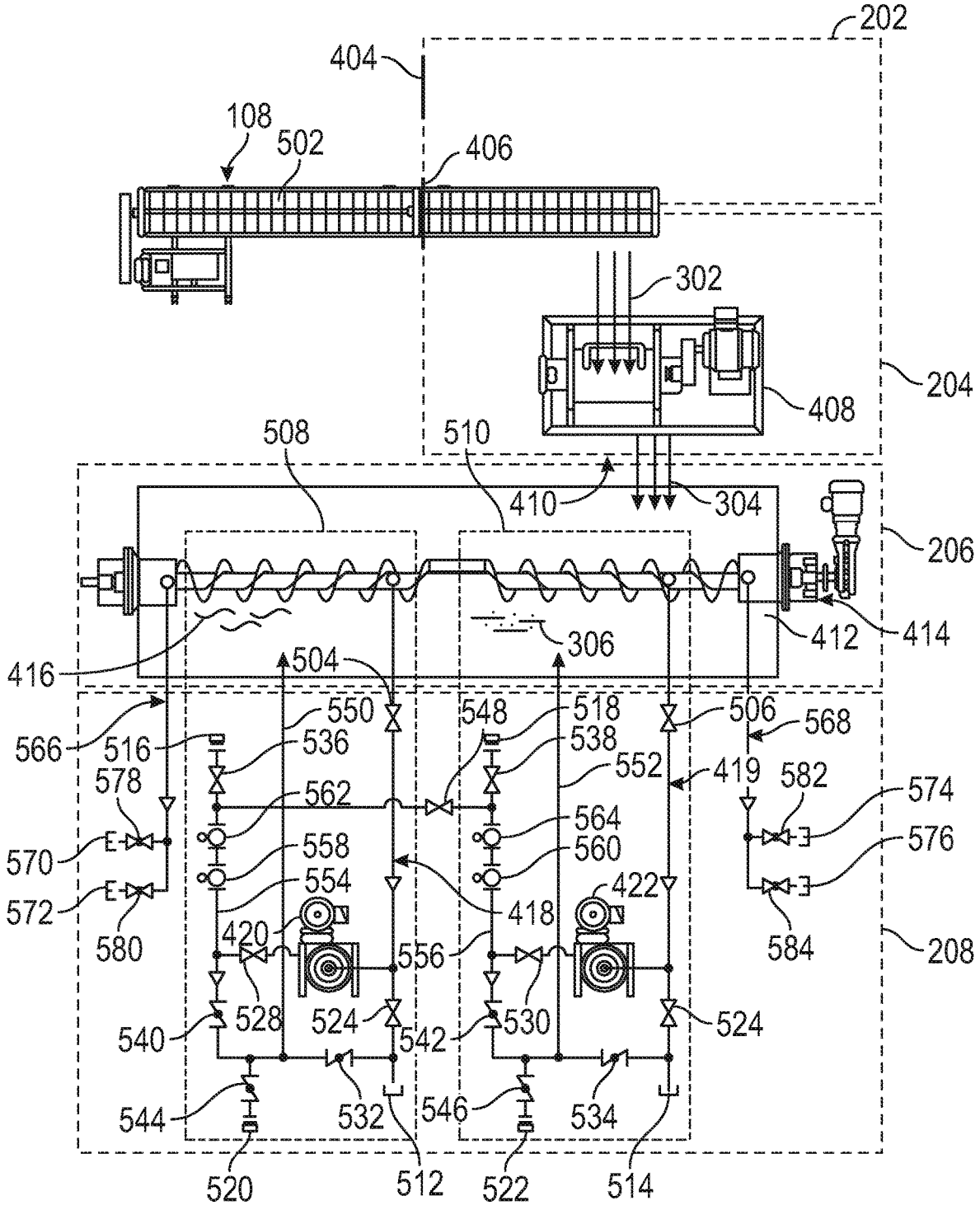
FIG. 5 is another schematic representation of a cuttings processing unit, according to one or more embodiments.

FIG. 5 is another schematic representation of a cuttings processing unit 102, according to one or more embodiments. The illustrated cuttings processing unit 102 includes a particle reduction breaker mill 408, a cuttings tank 412, a solids auger 414, pumps 420, 422, and a manifold of piping spools encompassing a series of manually or remotely operated valves that are provided to direct the slurry 306 throughout and away from the cuttings processing unit 102. The breaker mill 408 receives hydrocarbon contaminated drill cuttings 302 delivered by a screw conveyor 502 in the mud cleaning complex 108 through the conveyor interface 406 on the utility interface module 202 or the breaker mill module 204 The drill cuttings 304 then pass into the cuttings tank module 206 where the solids auger 414 agitates the resulting slurry 306 in the tank 412. The shearing action caused by the circulation of fluid 416 by the auger 414 assists in particle size reduction. The drill cuttings slurry 306 is then delivered through the primary suction piping spools 418, 419 and is directed by the opening and closing of valves 504, 506 to the pumps 420, 422.

The cuttings processing unit 102 is configured such that in the event of a pump breakdown, either pump 420, 422 may be isolated so operations may proceed. In the illustrated embodiment, this is facilitated by two separate pumps 420, 422 and two separate piping circuits 508, 510. First piping circuit 508 serves first pump 420 and allows the pump 420 to move the slurry 306 along a variety of paths. Similarly, second piping circuit 510 serves second pump 422 and allows the pump 422 to move the slurry 306 along a variety of paths. For example, the piping circuits 508, 510 may allow the pumps 420, 422 to move the slurry 306 to a vacuum truck, such as a Guzzler truck via vacuum truck connections 512, 514, back to the tank 412, to a disposal option via cuttings disposal connections 516, 518, and to receive additives at the additives connections 520, 522.

An operator may close valve 524 to have the slurry 306 pass through the first pump 420. An operator may close valves 528, 532 and open valve 524 to facilitate movement of the slurry 306 toward the vacuum truck connection 512. An operator may close valves 524, 536, 544, 548 and open valves 528, 540 to recirculate the slurry 306 back into the tank 412 through pump 420 via the secondary discharge piping spool 550. An operator may close valves 540, 548 and open valves 528, 536 to direct the slurry 306 toward the cuttings disposal connection 516 through pump 420 via the primary discharge piping spool 554. If additives, for example chemicals such as viscosity agents or corrosion inhibitors, are to be added to the slurry 306, then an operator may close valves 532, 540 and open valve 544 to direct the slurry 306 from additives connection 522 toward the tank 412.

An operator may close valve 524 to have the slurry 306 pass through the second pump 422. An operator may close valves 530, 534 and open valve 526 to facilitate movement of the slurry 306 toward the vacuum truck connection 514. An operator may close valves 524, 538, 546, 548 and open valves 530, 542 to recirculate the slurry 306 back into the tank 412 through pump 422 via the secondary discharge piping spool 552. An operator may close valves 542, 548 and open valves 530, 538 to direct the slurry 306 toward the cuttings disposal connection 518 through pump 422 via the primary discharge piping spool 556. If additives, for example chemicals such as viscosity agents or corrosion inhibitors, are to be added to the slurry 306, then an operator may close valves 534, 542 and open valve 546 to direct the slurry 306 from the additives connection 522 to the tank 412.

Since piping circuits 508, 510 are connected by valve 548, the direction of the slurry 306 in this manifold assembly may be directed by manipulation of the various valves and several configurations are possible. Each of pumps 420, 422 may be provided with a pressure gauge 558, 560 and a flow meter, 562, 564 located on the primary discharge spools 554, 556. In some embodiments, secondary suction piping spools 566, 568 may be provided to accommodate vac truck connections 570, 572, 574, 576 when additional suction is required from the cuttings tank 412. In the illustrated embodiment secondary suction piping spool 566 has the capability to service up to two vac trucks via vac truck connections 570, 572 and can be controlled using valves 578, 580. In the illustrated embodiment secondary suction piping spool 568 has the capability to service up to two vac trucks via vac truck connections 574, 576 and can be controlled using valves 582, 584. While the illustrated embodiment includes two pumps and two piping circuits, other embodiments may include more or less pumps and piping circuits. In some embodiments, the pumps 420, 422 are connected in parallel.

Figure 6:
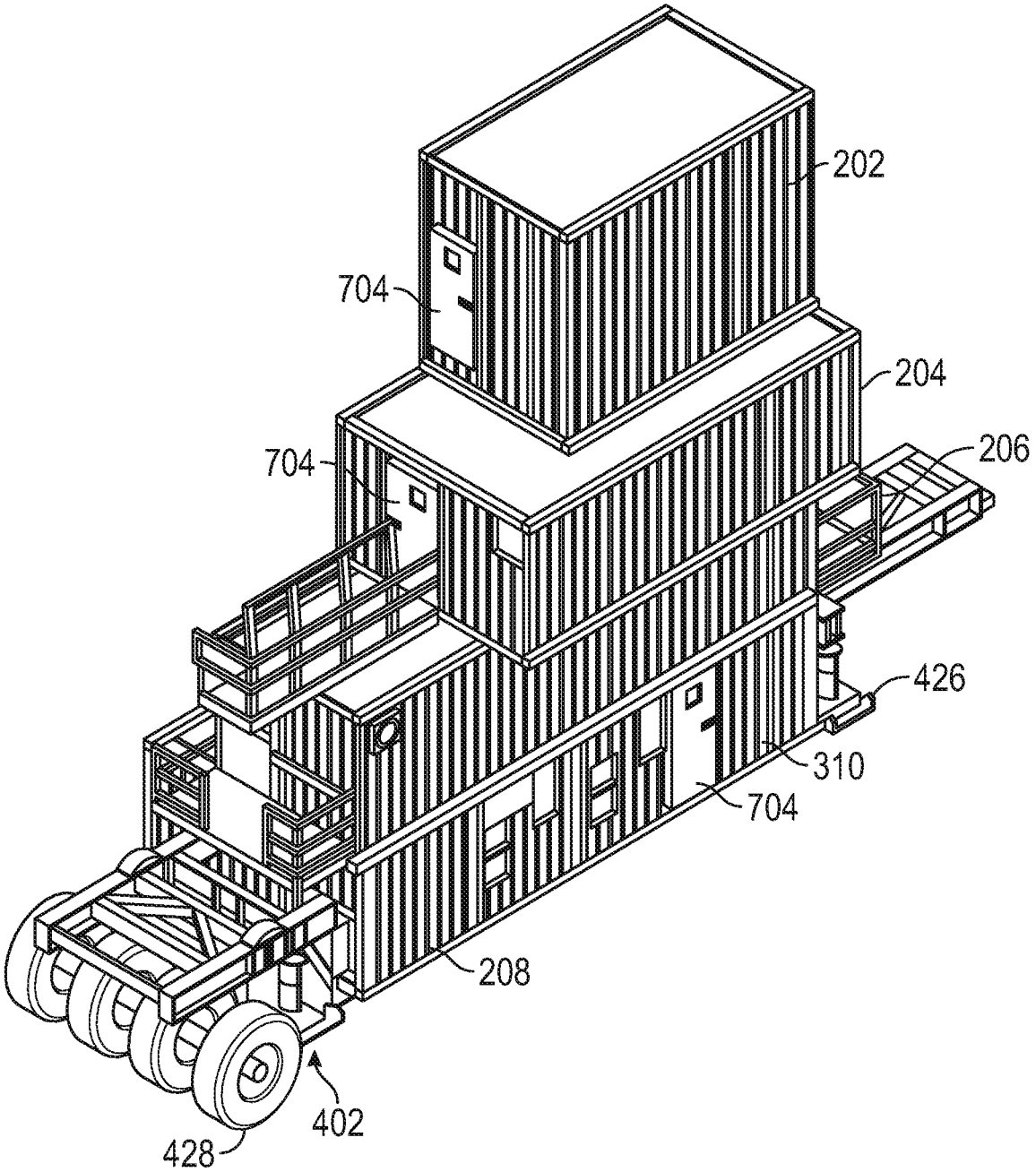
FIG. 6 is an isometric back view of a cuttings processing unit, according to one or more embodiments.
Figure 7:
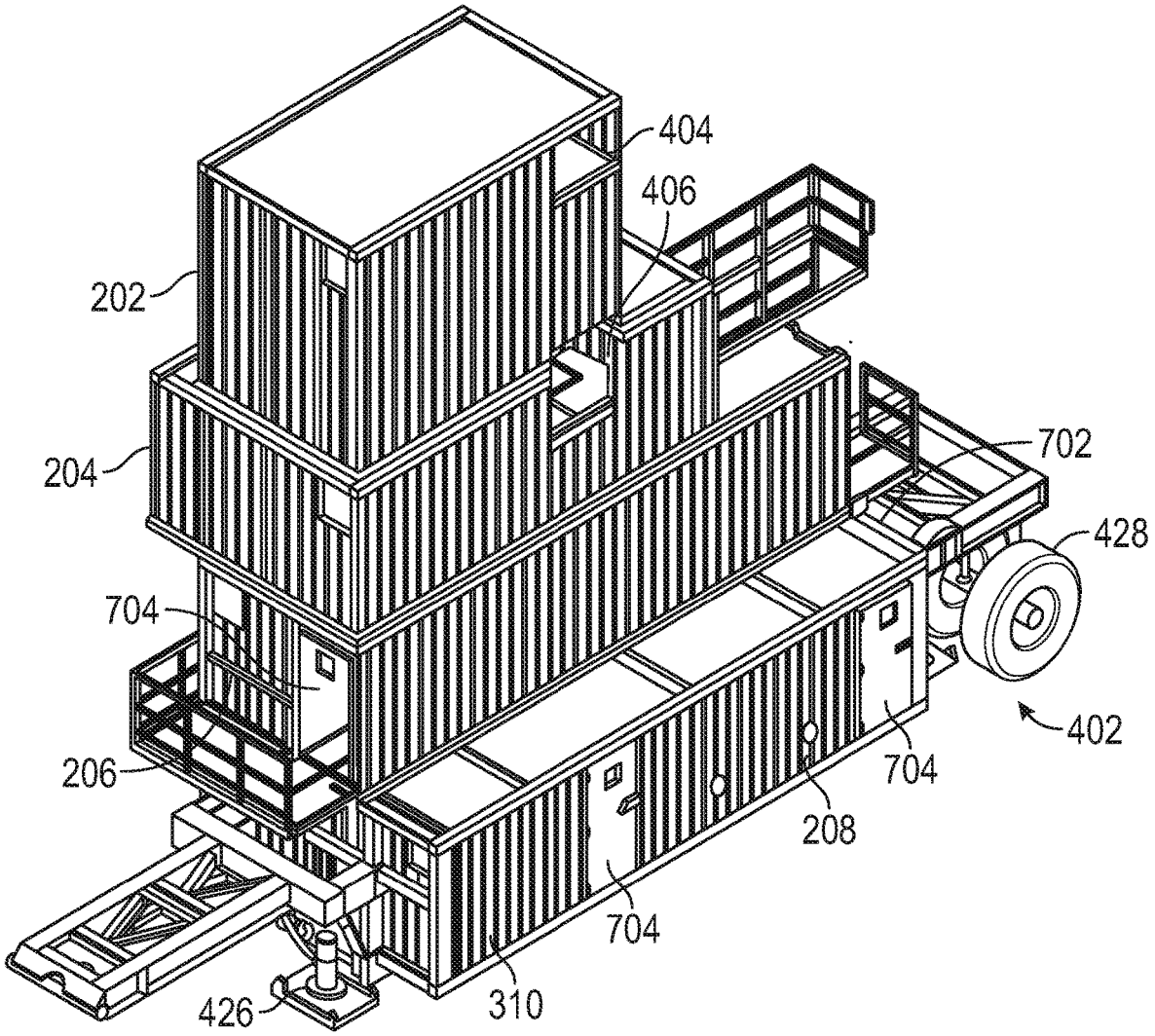
FIG. 7 is an isometric front view of a cuttings processing unit, according to one or more embodiments.

FIG. 6 is an isometric back view of a cuttings processing unit and FIG. 7 is an isometric front view of a cuttings processing unit, according to one or more embodiments. That is, FIG. 6 illustrates the long side of the cuttings processing unit 102 that faces the courtyard 114, and FIG. 7 illustrates the long side of the cuttings processing unit 102 that faces the mud cleaning complex 108. While the cuttings processing unit 102 is illustrated with the modules 202, 204, 206, 208, 310 fully assembled into a single integrated unit, the cuttings processing unit 102 may be disassembled its separate individual modules for transport or to replace an individual module. In this manner, the cuttings processing unit 102 need not be permanent, and can be transferred from one rig pad 100 to another. As noted in FIG. 2, the cuttings processing unit 102 may be configured such that a portion 702 of one or more modules (e.g. the pump module 208 and the control module 310) extends beneath or otherwise fits into the structure of the mud cleaning complex 108 when the cuttings processing unit 102 is positioned for operation. In some embodiments, each module 202, 204, 206, 208, 310 may include one or more access points 704 to allow for maintenance.

Figure 8:
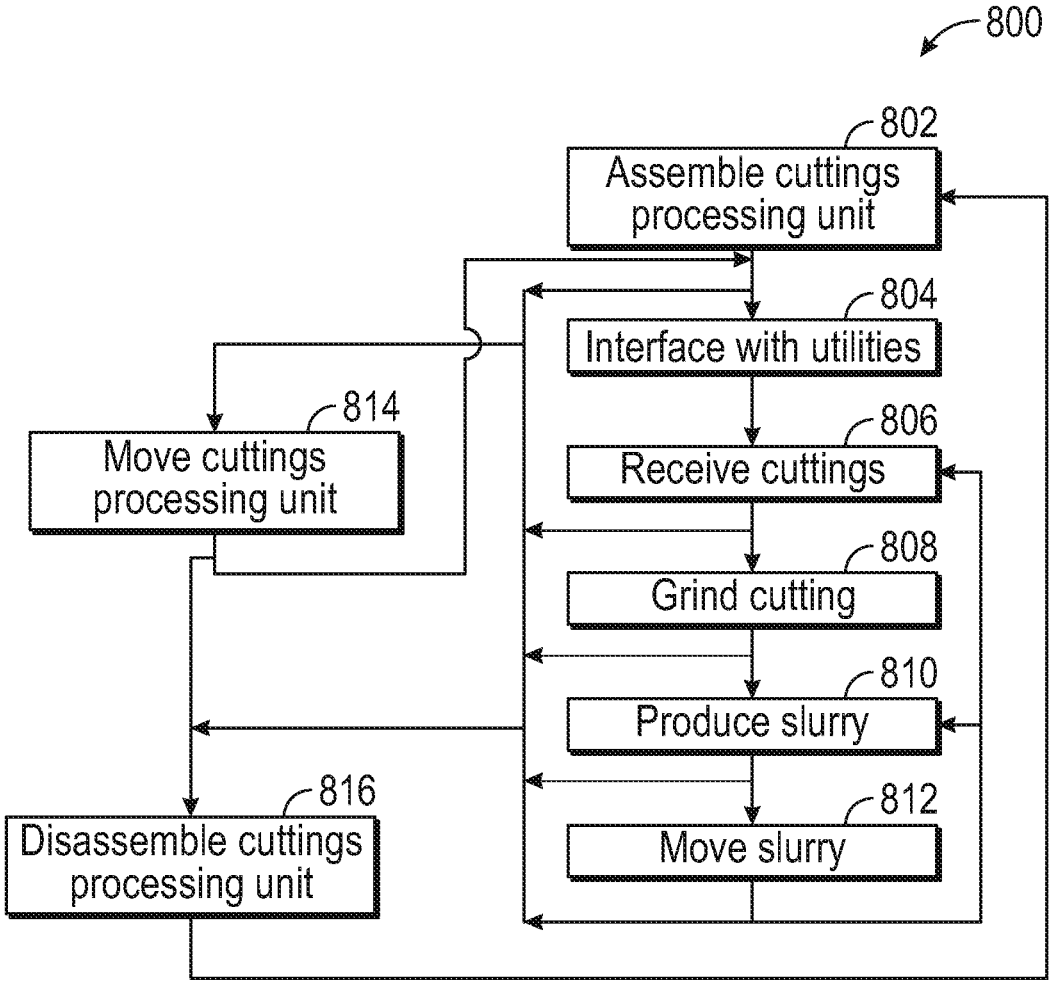
FIG. 8 is a flow chart depicting an example method of processing drill cuttings, according to one or more embodiments.

FIG. 8 is a flow chart depicting an example method 800 of processing drill cuttings 302, according to one or more embodiments. At block 802 the cuttings processing unit 102 may be assembled. In at least one embodiment, a plurality of modules 202, 204, 206, 208, 310 may be assembled together to form the cuttings processing unit 102. In at least one embodiment, a pump module 208 or a combined pump module 208/control module 310 may be positioned on top of a transporter 402. A cuttings tank module 206 may be stacked on or otherwise positioned above the pump module 208 and a breaker mill module 204 may be stacked on or otherwise positioned above the cuttings tank module 206. In at least one embodiment, a utilities interface module 202 may be stacked on or otherwise positioned above the breaker mill module 204. The modules 202, 204, 206, 208, 310 can be coupled using any of a variety of connectors, for example, pin connections, flanges, bolted connections, ISO sea can corner locks, male to female lug type connections with a dab pin, a combination of these, and the like. As assembled, each of the modules 202, 204, 206, 208, 310 is operably positioned such that the cuttings processing unit 102 may function to process drill cuttings 302 when introduced via the conveyor interface 406.

At block 804, the cuttings processing unit 102 interfaces with one or more utilities, such as the mud cleaning complex 108. The cuttings processing unit 102, is configured such that a long side of the cuttings processing unit 102 faces the mud cleaning complex 108, and a small side extends perpendicular to the mud cleaning complex 108. As such, the cuttings processing unit 102 is able to interface with the mud cleaning complex 108 while minimizing its interference with the courtyard 114. The utilities interface 404 may be coupled to or otherwise may engage the mud cleaning complex 108. In at least one embodiment, the conveyor interface 406 includes a window to receive a conveyor 502 of the mud cleaning complex 108. At block 806 the cuttings processing unit 102 receives the cuttings 302, for example via the utilities interface 404. In at least one embodiment, gravity may cause the cuttings processing unit 102 to receive the cuttings 302. In some embodiments, the breaker mill module 204 may receive the cuttings 302 via the utilities interface module 202.

At block 808, the mill 408 grinds the cuttings 302 into a finer composition 304. The mill 408 may comprise a ball mill. The mill 408 may be selected based on the desired qualities of the finer composition 304. The finer composition 304 may then pass to the cuttings tank module 206. In some embodiments, gravity may cause the finer composition 304 to move from the breaker mill module 204 to the cuttings tank module 206. At block 810, the auger 414 agitates fluid 416 and the finer composition 304 to create a slurry 306 in the cuttings tank module 206. In some embodiments, the auger 414 may further refine or break down the finer composition 304. The auger 414 may further prevent the finer composition 304 from clogging piping 418, 419.

At block 812 the at least one pump 420, 422 may move the slurry 306 along any of a variety of paths for any of a variety of purposes. For example, in some embodiments the at least one pump 420 422 may recirculate the slurry 306 back to the cuttings tank 412. In some embodiments, the at least one pump 420, 422 may move the slurry 306 toward a disposal connection 516, 518 such that the slurry can be disposed of. The piping 418, 419 facilitates movement of the slurry 306. In some embodiments the piping 418, 419 may facilitate additives (such as chemicals) being introduced to the slurry 306 via the additives connection 520, 522. In some embodiments, the piping 418, 419 may facilitate movement of the slurry 306 toward a vacuum truck connection 512, 514, such that a vacuum truck can suck the slurry 306 out of the piping 418, 419. The controller 424 may control the at least one pump 420, 422 and the valves throughout the piping circuits 508, 510, 566, 568, to control the flow of the slurry 306.

In some embodiments, at any point in the method 800, the cuttings processing unit 102 may be moved by the transporter 402. In some embodiments, a lift and roll system 426 may allow the cuttings processing unit 102 to be raised, lowered, moved a direction, tilted, rotated, a combination of these, or the like. In some embodiments, the lift and roll system 426 allows the cuttings processing unit 102 to be moved forward, backward, left, or right. In at least one embodiment, the lift and roll system 426 allows the cuttings processing unit 102 to be moved in any direction. In some embodiments, the transporter 402 may be a wheeled transporter to allow the cuttings processing unit 102 to be moved faster or over greater distances. In some embodiments, the cuttings processing unit 102 may be assembled and then moved into a better position for interfacing with the mud cleaning complex 108. In some embodiments, the cuttings processing unit 102 may be moved to accommodate other equipment or machinery. When the cuttings processing unit 102 is moved to (or back to) its operable position, the method 800 returns to block 804 such that the cuttings processing unit may interface with the mud cleaning complex 108 to start (or resume) processing drill cuttings 302. In at least one embodiment, the cuttings processing unit 102 is substantially empty of cuttings 302 or slurry 306 before the cuttings processing unit 102 is moved.

Alternatively, after moving the cuttings processing unit 102, the method 800 may proceed to block 816, and the cuttings processing unit 102 may be disassembled. In some embodiments, the cuttings processing unit 102 may be disassembled at a number of different points in method 800. In at least one embodiment, the cuttings processing unit 102 is substantially empty of cuttings 302 or slurry 306 before the cuttings processing unit 102 is disassembled. The cuttings processing unit 102 may be disassembled into two or more modules 202, 204, 206, 208, 310. In at least one example, disassembly may involve the reverse procedure of assembly. In at least one embodiment, the cuttings processing unit 102 may be fully or partially disassembled to replace one or more module 202, 204, 206, 208, 310 or to move the cuttings processing unit 102. Following disassembly, the method 800 may proceed to block 802 and the cuttings processing unit 102 may be assembled as needed.

In some embodiments, various portions of the method 800 may be repeated or may be performed simultaneously. For example, one or more of blocks 806, 808, 810, and 812 may be repeated or performed simultaneously. That is, in some embodiments, the cuttings processing unit 102 may receive cuttings, grind cuttings, produce slurry, and move slurry simultaneously and repeatedly. In some embodiments, a subset of those may be repeated or performed simultaneously. For example, the cuttings processing unit 102 may receive cuttings, grind cuttings and produce slurry continuously, but only move slurry intermittently.

The cuttings processing unit 102 allows the cuttings 302 to be processed onsite into a better composition for disposal (slurry 306). Further, the cuttings processing unit 102 is modular and mobile allowing for ease of installation, adjustment, and removal. Finally, the cuttings processing unit 102 has a minimal and efficient footprint on the drill pad 100, allowing for more room in the courtyard 114 than traditional systems and methods and allowing for easier access to other equipment surrounding the courtyard 114, while providing more functionality. In contrast, traditional rock washers are not mobile (they have to be loaded onto a truck to be transported), cannot grind cuttings or produce a slurry, and have a large footprint extending into the courtyard 114.

Various embodiments of the present disclosure may be described herein with reference to flowchart illustrations and/or block diagrams of methods, apparatus (systems), and control systems. Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A cuttings processing unit, comprising:

a plurality of containerized modules each having a longitudinal length and a width and arranged in stacked fashion, the plurality of containerized modules having a rig side configured for arrangement along and immediately adjacent a mud cleaning complex on a rig pad and an opposing courtyard side, each of the rig side and the courtyard side extending along the longitudinal length, the plurality of containerized modules comprising:

a conveyor interface arranged on the rig side of the plurality of containerized modules and configured to interface directly with the mud cleaning complex to receive drill cuttings;

a containerized breaker mill module operably positioned to receive drill cuttings from the conveyor interface, the breaker mill module configured to grind the cuttings into a finer composition;

a containerized cuttings tank module operably and physically stacked beneath the breaker mill module, the cuttings tank module configured to agitate the finer composition and create a slurry; and a containerized pump module operably and physically stacked beneath the cuttings tank module, the pump module configured to move the slurry.

2. The cuttings processing unit of claim 1, further comprising:

a control center module electrically coupled to the pump module and configured to control the cuttings processing unit.

3. The cuttings processing unit of claim 1, further comprising:

a transporter configured to move the cuttings processing unit.

4. The cuttings processing unit of claim 3, wherein the transporter includes a lift and roll system.

5. The cuttings processing unit of claim 1, wherein the containerized breaker mill module includes a ball mill.

6. The cuttings processing unit of claim 1, wherein the containerized cuttings tank module includes a tank housing an auger.

7. The cuttings processing unit of claim 1, further comprising:

suction piping coupled to the containerized cuttings tank module and the containerized pump module, such that the suction piping is configured to transfer the slurry from the containerized cuttings tank module to the containerized pump module.

8. The cuttings processing unit of claim 7, wherein the containerized pump module includes at least one pump configured to create suction in the suction piping.

9. The cuttings processing unit of claim 1, wherein the containerized breaker mill, containerized cuttings tank, and containerized pump modules are configured to be assembled to form a single integrated unit and disassembled into individual containerized modules.

10. The cuttings processing unit of claim 1, further comprising:

a utility interface module operably positioned above the containerized breaker mill module, wherein the utility interface module includes a utility interface.

11. A cuttings processing unit, comprising:

a containerized breaker mill having a rig side positioned along and immediately adjacent to a mud cleaning complex of a rig pad and configured to receive cuttings from the mud cleaning complex directly via a conveyor interface arranged on the rig side and grind the cuttings into a finer composition;

a containerized cuttings tank stacked below the containerized breaker mill to receive the finer composition from the containerized breaker mill, the containerized cuttings tank including an auger configured to agitate the finer composition, wherein the containerized cuttings tank is configured to transform the finer composition into a slurry;

at least one containerized pump stacked beneath the containerized cuttings tank; and piping in fluid connection with the containerized cuttings tank and the at least one containerized pump, such that the at least one containerized pump is configured to move the slurry through the piping.

12. The cuttings processing unit of claim 11, wherein:

the at least one containerized pump includes a first pump and a second pump; and the piping includes a first set of piping and a second set of piping, wherein the first set of piping is in fluid communication with the containerized cuttings tank and the first pump and the second set of piping is in fluid connection with the containerized cuttings tank and the second pump.

13. The cuttings processing unit of claim 11, wherein the piping includes:

suction piping extending between the containerized cuttings tank and the at least one containerized pump;

discharge piping extending between the containerized pump and at least one output; and a plurality of valves positioned to control movement of the slurry.

14. The cuttings processing unit of claim 11, wherein the containerized cuttings tank and the containerized breaker mill are configured such that gravity causes the finer composition to move from the containerized breaker mill to the containerized cuttings tank.

* * * * *